US011721473B2

(12) United States Patent
Ryu et al.

(10) Patent No.: US 11,721,473 B2
(45) Date of Patent: Aug. 8, 2023

(54) COIL COMPONENT

(71) Applicant: SAMSUNG ELECTRO-MECHANICS CO., LTD., Suwon-si (KR)

(72) Inventors: Joung Gul Ryu, Suwon-si (KR); Ji Man Ryu, Suwon-si (KR); Byeong Cheol Moon, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 706 days.

(21) Appl. No.: 16/550,877

(22) Filed: Aug. 26, 2019

(65) Prior Publication Data

US 2020/0118730 A1 Apr. 16, 2020

(30) Foreign Application Priority Data

Oct. 12, 2018 (KR) ..... 10-2018-0122107

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/323* (2013.01); *H01F 27/29* (2013.01); *H01F 2027/2809* (2013.01)

(58) Field of Classification Search
CPC ..... H01F 27/2804
(Continued)

(56) References Cited

U.S. PATENT DOCUMENTS

2013/0300529 A1* 11/2013 Chang ..... H01F 27/292 336/200
2013/0341758 A1 12/2013 Lee et al.
(Continued)

FOREIGN PATENT DOCUMENTS

CN 104766715 A 7/2015
CN 105097186 A 11/2015
(Continued)

OTHER PUBLICATIONS

Office action issued in corresponding Korean Patent Application No. 10-2020-0104450 dated Oct. 1, 2021, with English translation.
(Continued)

*Primary Examiner* — Ronald Hinson
(74) *Attorney, Agent, or Firm* — Morgan, Lewis & Bockius LLP

(57) ABSTRACT

A coil component includes a body, an insulating substrate embedded in the body and including an insulating resin, and first and second substrate protection layers covering respective surfaces of the insulating substrate to protect the insulating substrate and including a ceramic. A coil portion includes first and second coil patterns respectively disposed on the first and second substrate protection layers. Each of the first and second coil patterns includes a first conductive layer, disposed on the respective first or second substrate protection layer, and a second conductive layer disposed on the first conductive layer to expose a side surface of the first conductive layer.

19 Claims, 5 Drawing Sheets

(51) Int. Cl.
*H01F 27/32* (2006.01)
*H01F 27/29* (2006.01)

(58) Field of Classification Search
USPC ..... 336/200
See application file for complete search history.

(56) References Cited

U.S. PATENT DOCUMENTS

| | | | | |
|---|---|---|---|---|
| 2014/0022041 | A1 | 1/2014 | Park et al. | |
| 2014/0028430 | A1* | 1/2014 | Lee | H01F 27/292 336/200 |
| 2015/0035634 | A1* | 2/2015 | Nakamura | H01F 41/046 336/170 |
| 2015/0097647 | A1* | 4/2015 | Lee | H01F 17/0013 428/429 |
| 2015/0173197 | A1* | 6/2015 | Cho | H01F 41/046 361/748 |
| 2015/0325510 | A1 | 11/2015 | Choi et al. | |
| 2016/0042846 | A1* | 2/2016 | Wang | H01F 17/0006 336/200 |
| 2016/0276089 | A1 | 9/2016 | Inoue et al. | |
| 2016/0293320 | A1* | 10/2016 | Kim | H01F 27/32 |
| 2017/0032884 | A1* | 2/2017 | Choi | H01F 41/046 |
| 2017/0062113 | A1 | 3/2017 | Otsubo et al. | |
| 2017/0178789 | A1 | 6/2017 | Kim et al. | |
| 2017/0178790 | A1* | 6/2017 | Kim | H01F 17/04 |
| 2018/0197672 | A1 | 7/2018 | Kim et al. | |
| 2018/0268988 | A1 | 9/2018 | Lee et al. | |

FOREIGN PATENT DOCUMENTS

| | | | |
|---|---|---|---|
| CN | 105989987 | A | 10/2016 |
| CN | 106463240 | A | 2/2017 |
| CN | 106783069 | A | 5/2017 |
| CN | 108281261 | A | 7/2018 |
| JP | 2000-150303 | A | 5/2005 |
| KR | 10-0513347 | B1 | 9/2005 |
| KR | 10-2014-0011693 | A | 1/2014 |
| KR | 10-1580709 | B1 | 12/2015 |
| KR | 10-2017-0073167 | A | 6/2017 |
| KR | 10-1863280 | B1 | 5/2018 |
| KR | 10-2018-0081475 | A | 7/2018 |

OTHER PUBLICATIONS

Office Action issued in corresponding Korean Patent Application No. 10-2018-0122107 dated Oct. 12, 2018, with English translation.
Chinese Office Action dated Aug. 31, 2022, issued in corresponding Chinese Patent Application No. 201910923022.8.

* cited by examiner

COIL COMPONENT

CROSS-REFERENCE TO RELATED APPLICATION(S)

This application claims benefit of priority to Korean Patent Application No. 10-2018-0122107 filed on Oct. 12, 2018 in the Korean Intellectual Property Office, the disclosure of which is incorporated herein by reference in its entirety.

BACKGROUND

1. Field

The present disclosure relates to a coil component.

2. Description of Related Art

An inductor, a coil component, is a representative passive electronic component commonly used in electronic devices together with resistors and capacitors.

A thin-film type inductor is commonly manufactured by forming a coil on a substrate by plating to form a coil substrate, forming a body by laminating a magnetic powder-resin composite obtained by mixing a magnetic powder and a resin with each other, and forming external electrodes on external surfaces of the body.

In accordance with the implementation of high performance electronic devices and the miniaturization thereof, thin-film type coil components used in such electronic devices have also been miniaturized. Accordingly, a substrate of a thin-film coil electronic component has been thinned.

However, when a substrate is gradually thinned, there is high possibility that the substrate will be damaged during a manufacturing process.

SUMMARY

An aspect of the present disclosure is to provide a coil component which may prevent damage to an insulating substrate during a manufacturing process.

According to an aspect of the present disclosure, a coil component includes a body, an insulating substrate embedded in the body and including an insulating resin, and first and second substrate protection layers covering respective surfaces of the insulating substrate to protect the insulating substrate and including a ceramic. A coil portion includes first and second coil patterns respectively disposed on the first and second substrate protection layers. Each of the first and second coil patterns includes a first conductive layer, disposed on the respective first or second substrate protection layer, and a second conductive layer disposed on the first conductive layer to expose a side surface of the first conductive layer.

According to another aspect of the present disclosure, a coil component includes a body including metal magnetic powder particles, an insulating substrate embedded in the body, a coil portion including a coil pattern disposed on the insulating substrate, and a substrate protection layer, disposed on at least one surface of the insulating substrate between the insulating substrate and the coil portion to protect the insulating substrate, having a melting point higher than a melting point of the insulating substrate.

According to a further aspect of the present disclosure, a coil component includes an insulating substrate, a coil portion including first and second coil patterns disposed on opposing surfaces of the insulating substrate, and first and second ceramic layers each disposed between the insulating substrate and a respective one of the first and second coil patterns.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
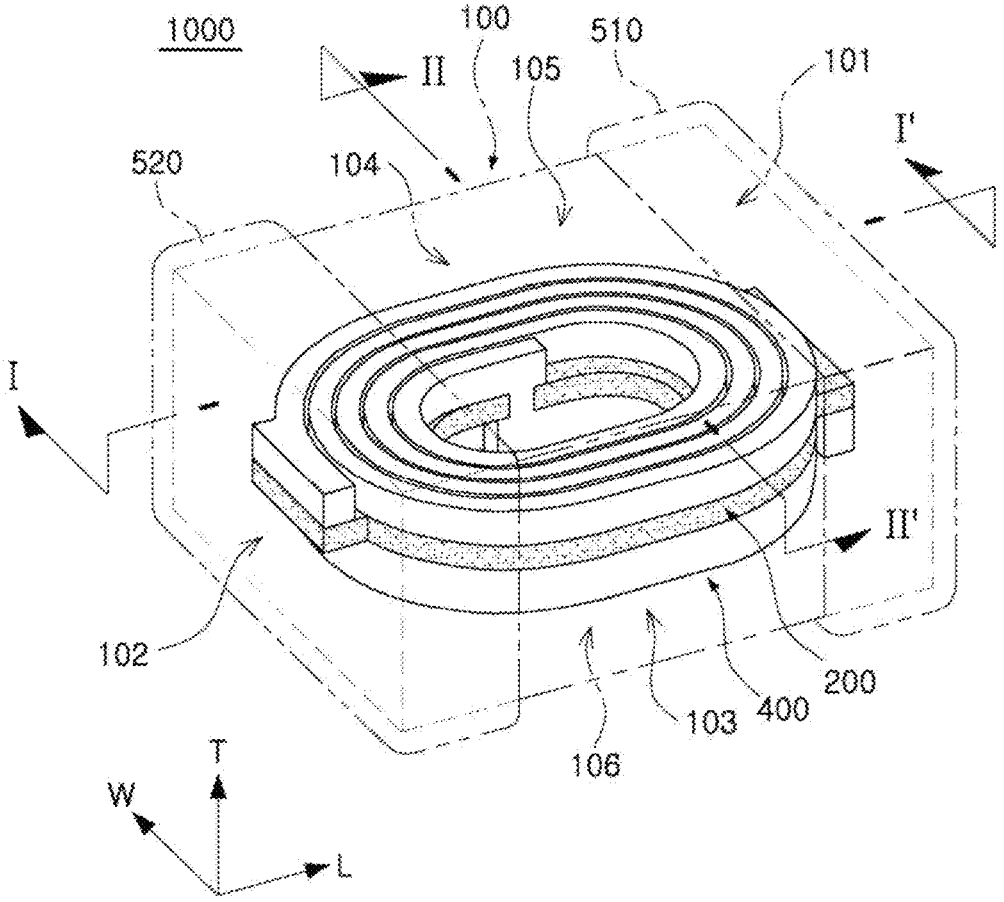
FIG. 1 is a schematic diagram of a coil component according to an example embodiment in the present disclosure.

Hereinafter, embodiments of the present disclosure will be described as follows with reference to the attached drawings.

The terms used in the example embodiments are used to simply describe an example embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more further features, numbers, steps, operations, elements, parts or combination thereof. Also, the terms "disposed on," "positioned on," and the like, may indicate that an element is positioned below an object, and does not necessarily mean that the element is positioned on the object with reference to a gravity direction.

The term "coupled to," "combined to," and the like, may not only indicate that elements are directly and physically in contact with each other, but also include configurations in which the other element is interposed between the elements such that the elements are also in contact with the other component.

Sizes and thicknesses of elements illustrated in the drawings are indicated as examples for ease of description, and example embodiments in the present disclosure are not limited thereto.

In the drawings, an L direction is a first direction or a length direction, a W direction is a second direction or a width direction, and a T direction is a third direction or a thickness direction.

In electronic devices, various types of electronic components may be used, and various types of coil components may be used between the electronic components to remove noise or for other purposes.

In other words, in electronic devices, a coil component may be used as a power inductor, a high frequency inductor, a general bead, a high frequency bead, a common mode filter, and the like.

One Embodiment

Figure 2:
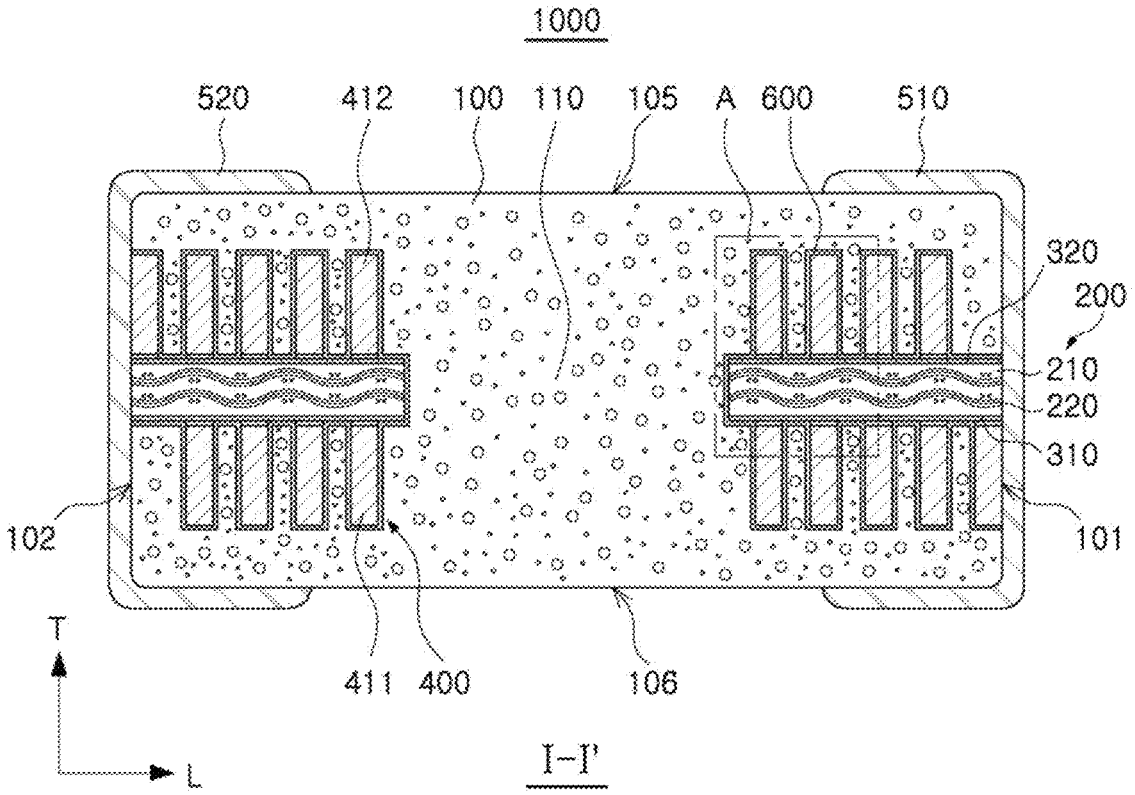
FIG. 2 is a cross-sectional view taken along line I-I' of FIG. 1.
Figure 3:
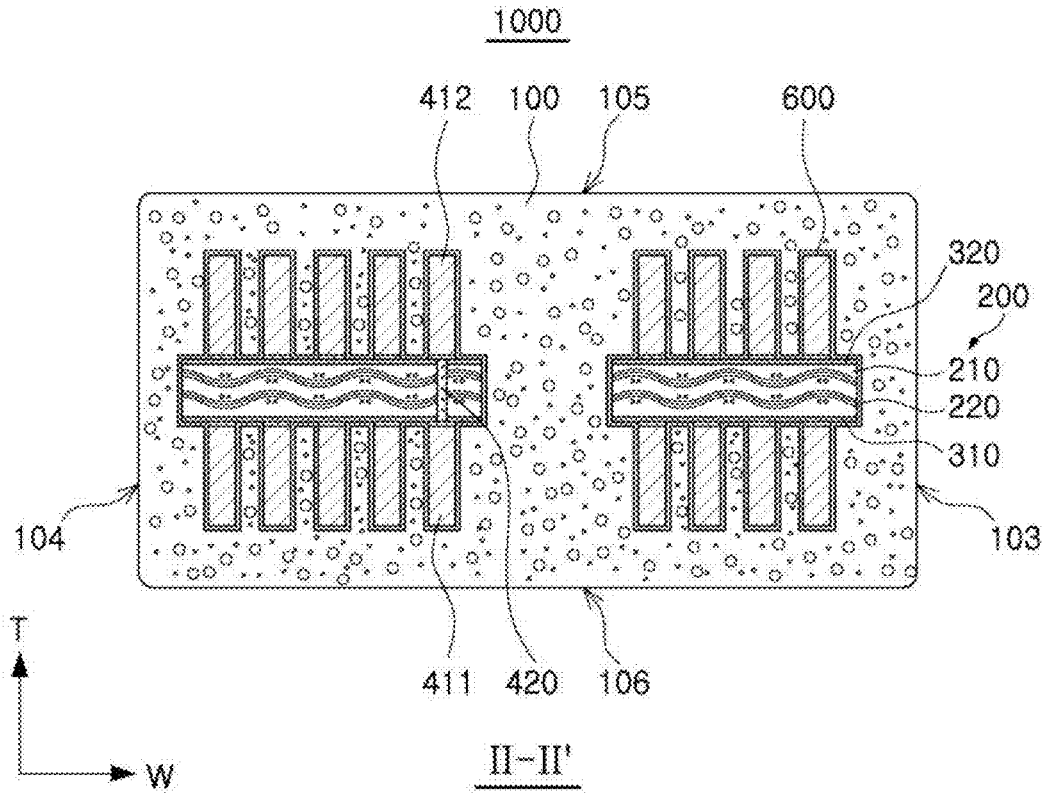
FIG. 3 is a cross-sectional view taken along line II-II' of FIG. 1.
Figure 4:
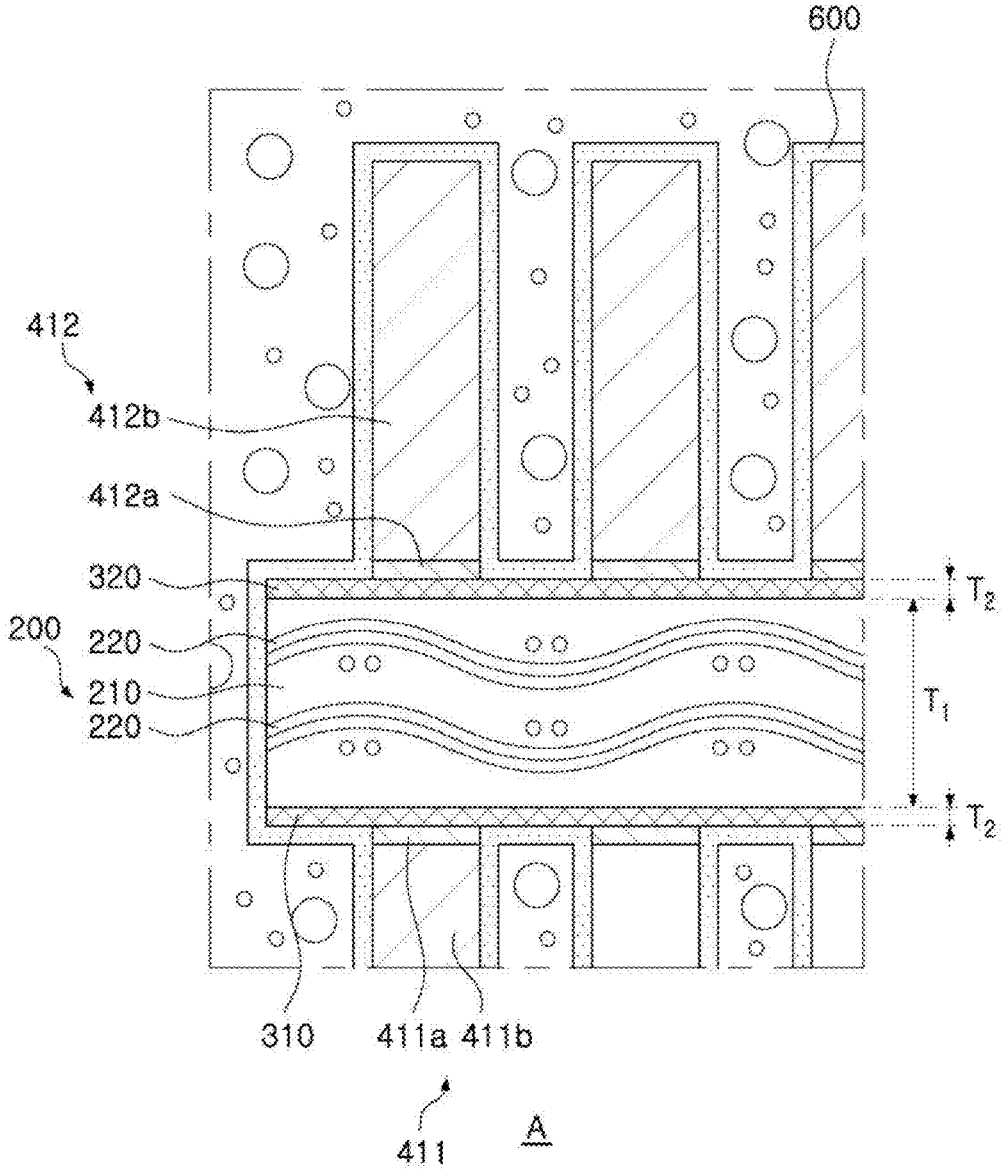
FIG. 4 is an enlarged view of portion A of FIG. 2.

FIG. 1 is a schematic diagram of a coil component according to an example embodiment in the present disclosure. FIG. 2 is a cross-sectional view of the coil component taken along line I-I' of FIG. 1, FIG. 3 is a cross-sectional view of the coil component taken along line II-II' of FIG. 1, and FIG. 4 is an enlarged view of portion A of FIG. 2.

Referring to FIGS. 1 to 4, a coil component 1000 according to an example embodiment includes a body 100, an insulating substrate 200, substrate protection layers 310 and 320, a coil portion 400, and external electrodes 510 and 520.

The body 100 forms an exterior of the coil component 1000, and the insulating substrate 200, the substrate protection layers 310 and 320, and the coil portion 400 are embedded in the body 100.

The body 100 may have a substantially hexahedral shape.

The body 100 may have, on the basis of FIGS. 1 to 3, a first surface 101 and a second surface 102 opposing each other in a length direction L, a third surface 103 and a fourth surface 104 opposing each other in a width direction W, and a fifth surface 105 and a sixth surface 106 opposing each other in a thickness direction T. The first to fourth surfaces 101, 102, 103, and 104 of the body 100 may correspond to wall surfaces of the body 100 connecting the fifth surface 105 and the sixth surface 106 of the body 100. Hereinafter, "both end surfaces of the body 100" will refer to the first surface 101 and the second surface 102, and "both side surfaces of the body 100" will refer to the third surface 103 and the fourth surface 104 of the body 100. In addition, "one surface and the other surface of the body 100" will refer to the sixth surface 106 and the fifth surface 105.

As an example, the body 100 may be formed such that the coil component 1000, on which the external electrodes 510 and 520 to be described later are disposed, may have a length of 2.0 mm, a width of 1.2 mm, and a thickness of 0.65 mm, but the formation of the body 100 is not limited thereto.

The body 100 may include a magnetic material and a resin material. Specifically, the body 110 may be formed by laminating one or more magnetic composite sheets including a magnetic material dispersed in a resin. Alternatively, the body 100 may have a structure different from the structure in which a magnetic material is dispersed in a resin. For example, the body 100 may be formed of a magnetic material such as a ferrite.

The magnetic material may be a ferrite or magnetic metal powder particles.

The ferrite powder particles may include at least one of, for example, spinel type ferrites such as ferrites that are Mg-Zn-based, Mn-Zn-based, Mn-Mg-based, Cu-Zn-based, Mg-Mn-Sr-based, Ni-Zn-based, hexagonal ferrites such as ferrites that are Ba-Zn-based, Ba-Mg-based, Ba-Ni-based, Ba-Co-based, Ba-Ni-Co-based, or the like, garnet ferrites such as Y-based ferrite, and Li-based ferrite.

Magnetic metal powder particles may include at least one selected from a group consisting of iron (Fe), silicon (Si), chromium (Cr), cobalt (Co), molybdenum (Mo), aluminum (Al), niobium (Nb), copper (Cu), and nickel (Ni). For example, the magnetic metal powder particles may include at least one of pore ion powder particles, Fe-Si-based alloy powder particles, Fe-Si-Al-based alloy powder particles, Fe-Ni-based alloy powder particles, Fe-Ni-Mo-based alloy powder particles, Fe-Ni-Mo-Cu-based alloy powder particles, Fe-Co-based alloy powder particles, Fe-Ni-Co-based alloy powder particles, Fe-Cr-based alloy powder particles, Fe-Cr-Si-based alloy powder particles, Fe-Si-Cu-Nb-based alloy powder particles, Fe-Ni-Cr-based alloy powder particles, and Fe-Cr-Al-based alloy powder particles.

The metallic magnetic powder particles may be amorphous or crystalline. For example, the magnetic metal powder particles may be Fe-Si-B-Cr-based amorphous alloy powder particles, but is not limited thereto.

Each of the ferrite and the magnetic metal powder particles may have an average diameter of about 0.1 μm to about 30 μm, but an example of the average diameter is not limited thereto.

The body 100 may include two or more different types of magnetic materials dispersed in a resin. The expression "different types of magnetic materials" refers to the magnetic materials, dispersed in the resin, being distinguished from each other by any one of an average diameter, a composition, crystallinity, and a shape.

The resin may include epoxy, polyimide, liquid crystal polymer, and the like, alone or in combination, but a material of the resin is not limited thereto.

The body 100 includes a core 110 penetrating through the coil portion 400 to be described later. The core 110 may be formed by filling a through-hole of the coil portion 400 with the magnetic composite sheet, but formation of the core 110 is not limited thereto.

The insulating substrate 200 is embedded in the body 100. The insulating substrate 200 serves to support the coil portion 400 to be described later.

The insulating substrate 200 may be formed of an insulating material including at least one thermosetting insulating resin such as an epoxy resin, thermoplastic insulating resins such as polyimide, and photosensitive insulating resins, or an insulating material in which a reinforcing material such as glass fiber or an inorganic filler is impregnated in this insulating resin. As an example, the internal insulating layer IL may be formed of an insulating material such as prepreg, an Ajinomoto build-up film (ABF), FR-4, a Bismaleimide Triazine (BT) resin, a photoimageable dielectric (PID), or the like, but is not limited thereto.

The inorganic filler may be at least one selected from the group consisting of silica ($SiO_2$), alumina ($Al_2O_3$), silicon carbide (SiC), barium sulfate ($BaSO_4$), talc, mud, mica powder, aluminum hydroxide ($AlOH_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$).

In this embodiment, the insulating substrate 200 includes a glass cloth 220 impregnated in an insulating resin 210. The glass cloth 220 refers to a plurality of woven glass fibers.

A glass cloth may be formed of a plurality of layers. When the glass cloth includes a plurality of layers, rigidity of the insulating substrate 200 may be improved. In addition, even if the glass cloth is damaged during a process of removing a seed layer of the insulating substrate 200 or the like, a shape of the insulating substrate 200 may be maintained to reduce a defect rate.

The coil portion 400 may be embedded in the body 100 to exhibit characteristics of a coil component. For example, when the coil component 1000 according to this embodiment is used as a power inductor, the coil portion 400 may serve to stabilize power of an electronic device by storing an electric field as a magnetic field and maintaining an output voltage.

The substrate protection layers 310 and 320 cover at least one surface of the insulating substrate 200 to protect the insulating substrate 200, and include ceramic. Specifically, the substrate protection layers 310 and 320 are each disposed on a surface of the insulating substrate on which a respective one of the coil patterns 411 and 412 of the coil portion 400 is formed. In this embodiment, since the coil portion 400 to be described later includes the coil patterns 411 and 412, respectively formed on opposing surfaces of the insulating substrate 200, the substrate protection layers 310 and 320 are respectively disposed on the opposing surfaces of the insulating substrate 200 and have a structure in which the coil patterns 411 and 412 are disposed on the substrate protection layers 310 and 320, respectively.

The substrate protective layers 310 and 320 protect the insulating substrate 200 during manufacturing of the coil component 1000 according to this embodiment. As an example, a process of removing a plating resist, not illustrated, formed on the insulating substrate 200, is used to plate the coil patterns 411 and 412 during the manufacturing. The substrate protection layers 310 and 320 prevent the insulating substrate 200 from being damaged by laser or an etchant in the process of removing the plating resist, not illustrated.

The substrate protection layers 310 and 320 include ceramic having a melting point higher than a melting point of the insulating substrate 200. As an example, the substrate protection layers 310 and 320 may include ceramic including at least one of zirconia ($ZrO_2$), alumina ($Al_2O_3$), silica ($SiO_2$), and yttria ($Y_2O_3$), but a material thereof is not limited thereto.

The substrate protection layers 310 and 320 may be formed on at least one surface of the insulating substrate 200 to which the vias 420 extend by a melt spraying method, but formation of the substrate protection layers 310 and 320 is not limited thereto. As another example, the substrate protection layers 310 and 320 may be formed on at least one surface of the insulating substrate 200 by a method such as plasma-enhanced chemical vapor deposition (PECVD), a coating method, or the like.

When a laser is used in the above-described process of removing plating resist, at least a portion of an insulating substrate based on an insulating resin may be removed together with the plating resist so as to thereby be damaged. Since the substrate protection layers 310 and 320 include ceramics having a melting point higher than a melting point of the insulating substrate 200, in cases in which the substrate protection layers 310 and 320 are provided, the insulating substrate 200 may be prevented from being damaged by the laser even when the plating resist is removed using the laser.

The insulating substrate 200 of this embodiment includes an insulating resin and a glass cloth having melting points different from each other. In the specification, the melting point of the insulating substrate 200 is used to refer to a relatively lower melting point of the insulating resin.

A ratio $T_2/T_1$ of a thickness $T_2$ of each of the substrate protection layers 310 and 320 to a thickness $T_1$ of the insulating substrate 200 may be 1/3000 or more to 1/4 or less. For example, the insulating substrate 200 may be formed to have a thickness of 10 μm to 60 ρm, and each of the substrate protection layers 310 and 320 may be formed to have a thickness of 0.02 μm to 5 μm. When the thickness $T_1$ of the insulating substrate 200 is less than 10 μm, the insulating substrate 200 may be warped and may thereby increase a defect rate and cause poor withstand voltage characteristics. When the thickness $T_1$ of the insulating substrate 200 is greater than 60 μm, the total thickness of the coil portion may be increased and may thereby be disadvantageous for thinning. When the thickness $T_2$ of each of the substrate protection layers 310 and 320 is less than 0.02 μm, the insulating substrate 200 may be exposed and damaged in the above-described process of removing plating resist. When the thickness $T_2$ of the substrate protection layers 310 and 320 is greater than 5 μm, the entire thickness of the coil component may be increased and may thereby be disadvantageous for thinning and brittleness may be increased. When the thickness ratio $T_2/T_1$ of each of the substrate protection layers 310 and 320 to the thickness of the insulating substrate 200 is less than 1/3000, the thickness of each of the substrate protection layers 310 and 320 is relatively small compared to the thickness of the insulating substrate 200 and may thereby increase possibility that the insulating substrate 200 is exposed. When the thickness ratio $T_2/T_1$ of each of the substrate protection layers 310 and 320 to the thickness of the insulating substrate 200 is greater than 1/4 of the thickness of the substrate protection layer 310 and 320, the thickness of the substrate protection layer 310 is relatively great, and thus, possibility of brittle fracture of the substrate protection layers 310 and 320 may be increased.

The coil portion 400 is formed on the substrate protection layers 310 and 320, disposed on the surface of the insulating substrate 200, and forms at least one turn. In this embodiment, the coil portion 400 includes first and second coil patterns 411 and 412, formed on opposing sides of the insulating substrate 200 opposing each other in the thickness direction T of the body 100, and one or more vias 420 penetrating through the insulating substrate 200 and the substrate protection layers 310 and 320 connect the first and second coil patterns 411 and 412 to each other. Accordingly, the coil portion 400 may generally serve as a single coil.

Each of the first and second coil patterns 411 and 412 may have a shape of a plane coil forming at least one turn around the core 110. For example, the first coil pattern 411 may form at least one turn around the core 110 on the bottom surface of the insulating substrate 200 disposed below the second coil pattern 412 on the basis of FIG. 2.

End portions of the first and second coil patterns 411 and 412 are connected to the first and second external electrodes 510 and 520 to be described later, respectively. For example, the end portion of the first coil pattern 411 is connected to the first external electrode 510, and the end portion of the second coil pattern 412 is connected to the second external electrode 520.

As an example, the end portion of the first coil pattern 411 may be exposed to the first surface 101 of the body 100, and the end portion of the second coil pattern 412 may be exposed to the second surface 102 of the body 100. Thus, the exposed end portions of the first and second coil patterns 411 and 412 may be in contact with and connected to the first and second external electrodes 510 and 520 disposed on the first and second surfaces 101 and 102 of the body 100, respectively.

The first and second coil patterns 411 and 412 include first conductive layers 411*a* and 412*a*, disposed on the substrate protection layers 310 and 320, and second conductive layers 411*b* and 412*b* disposed on the first conductive layers 411*a* and 412*a*, respectively. For example, the first coil pattern 411 includes a first conductive layer 411*a*, disposed directly on the substrate protection layer 310, and a second conductive layer 411*b* disposed on the first conductive layer 411*a* to expose a side surface of the first conductive layer 411*a*. The second coil pattern 412 includes a first conductive layer 412*a*, disposed directly on the second substrate protection layer 320, and a second conductive layer 412*b* disposed on the first conductive layer 412*a* to expose a side surface of the first conductive layer 412*a*.

The first conductive layers 411*a* and 412*a* may be seed layers for forming the second conductive layers 411*b* and 412*b* by electroplating. Each of the first conductive layers 411*a* and 412*a*, serving as a seed layer of the corresponding second conductive layer 411*b* or 412*b*, is formed to have a thickness smaller than a thickness of the corresponding second conductive layer 411*b* or 412*b*. The first conductive layers 411*a* and 412*a* may be formed by a thin-film process such as sputtering or an electroless plating process. When the first conductive layers 411*a* and 412*a* are formed by a thin-film process such as sputtering, at least a part of materials constituting the first conductive layers 411*a* and 412*a* may have a form penetrating through the substrate protection layers 310 and 320. This may be evidenced by occurrence of a difference between concentrations of metal materials constituting the first conductive layers 411*a* and 412*a* in a side of one surface, disposed in contact with the first conductive layers 411*a* and 412*a*, and in a side of the other surface opposing the one surface, among opposing surfaces of the substrate protection layers 310 and 320.

The via 420 may include at least one conductive layer. For example, when the via 420 is formed by electroplating, the via 420 may include a seed layer, formed on an internal wall of a via hole penetrating through the insulating substrate 200 and the substrate protection layers 310 and 320, and an electroplating layer filling a via hole in which the seed layer is formed. The seed layer of the via 420 may be formed together with the first conductive layers 411*a* and 412*a* in the same process to be integrated with each other, or may be formed in a process different from a process of forming the first conductive layers 411*a* and 412*a* to form a boundary therebetween. In this embodiment, the seed layer and the first conductive layers 411*a* and 412*a* of the via may be formed in different processes from each other to form a boundary therebetween.

When line widths of the coil patterns 411 and 412 are significantly large, the volume of a magnetic material in the same body 100 may be decreased to have an adverse effect on inductance. As a non-limiting example, an aspect ratio of the coil patterns 411 and 412 may advantageously be 3:1 to 9:1.

Each of the coil patterns 411 and 412 and the via 420 may be formed of a conductive material such as copper (Cu), aluminum (Al), silver (Ag), tin (Sn), gold (Au), nickel (Ni), lead (Pb), titanium (Ti), or alloys thereof, but a material thereof is not limited thereto. For example, when the first conductive layers 411*a* and 412*a* are formed by sputtering and the second conductive layers 411*b* and 412*b* are formed by electroplating, the first conductive layers 411*a* and 412*a* may include at least one of molybdenum (Mo), chromium (Cr), and titanium (Ti), and the second conductive layers 411*b* and 412*b* may include copper (Cu). As another non-limiting example, when the first conductive layers 411*a* and 412*a* are formed by electroless plating while the second conductive layers 411*b* and 412*b* are formed by electroplating, the second conductive layers 411*b* and 412*b* may include copper (Cu). In this case, density of copper (Cu) in the first conductive layers 411*a* and 412*a* may be lower than density of copper (Cu) in the second conductive layers 411*b* and 412*b*.

The insulating layer 600 may be formed along surfaces of the coil patterns 411 and 412, the substrate protection layers 310 and 320, and the insulating substrate 200. The insulating layer 600 is formed on the surfaces of the coil patterns 411 and 412 and the substrate protection layers 310 and 320 and the insulating substrate 200 to protect the coil patterns 411 and 412 and the coil patterns 411 and 412, and may include an insulating material such as parylene. The insulating material, included in the insulating layer 600, may be any material and is not limited. The insulating layer 600 may be formed by a thin-film process such as vapor deposition, but a forming method thereof is not limited thereto. As another example, the insulating layer 600 may be formed by laminating an insulating material such as an insulating film on both surfaces of the insulating substrate 200, or by applying a liquid insulating resin to both surfaces of the insulating substrate 200.

The external electrodes 510 and 520 are formed on the first and second surfaces 101 and 102, respectively, of the body 100 to be in contact with and connected to the coil portion 400.

The external electrodes 510 and 520 may be formed of a metal having improved electrical conductivity and may be formed of a metal such as, for example, nickel (Ni), copper (Cu), tin (Sn), or silver (Ag), either alone or in an alloy thereof.

Each of the external electrodes 510 and 520 may include a plurality of layers. For example, the external electrodes 510 and 520 may have a structure in which at least one plating layer is formed on a resin electrode layer including an insulating resin and a conductive material. The plating layer may include at least one selected from the group consisting of nickel (Ni), copper (Cu), and tin (Sn). For example, a nickel (Ni) plating layer and a tin (Sn) plating layer may be sequentially formed.

Although not illustrated in the drawings, the coil component according to this embodiment may further include an additional insulating layer disposed in contact with at least one of the first to sixth surfaces 101, 102, 103, 104, 105, and 106 of the body 100. As an example, when the additional insulating layer is disposed on the fifth and sixth surfaces 105 and 106 of the body 100, portions of the external electrodes 510 and 520, respectively extending to the fifth and sixth surfaces 105 and 106 of the body 100, may be in contact with and connected to the additional insulating layer. The additional insulating layer may include a thermoplastic resin such as a polystyrene resin, a vinyl acetate resin, a polyester resin, a polyethylene resin, a polypropylene resin, a polyamide resin, a rubber resin, an acrylic resin, and the like, or a thermosetting resin such as a phenolic resin, an epoxy resin, a urethane resin, a melamine resin, an alkyd resin, and the like, a photoimageable resin, parylene, $SiO_x$, or $SiN_x$. The additional insulating layer may be formed by laminating an insulating film on the surface of the body 100, by depositing an insulating material on the surface of the body 100 by a thin-film process, or by applying an insulating resin on the surface of the body 100 by screen printing or the like.

When a coil portion is formed on an insulating substrate by plating, a seed layer should be formed on the insulating substrate first. For example, in the case of a typical coil component, a seed layer is formed on an entire surface of the insulating substrate (a seed layer forming process). In turn, a plating resist, having an opening corresponding to the coil pattern, is formed on the seed layer (a plating resist forming process), and the opening of the plating resist is filled by electroplating (an electroplating process). Finally, the plating resist is removed (a plating resist removing process), and the seed layer, exposed to a region in which the plating resist is removed, is removed (a seed layer removing process).

In this case, laser may be used to remove the plating resist and the seed layer to prevent metal loss of the electroplating layer. At this point, a portion of the insulating substrate may be removed together with the seed layer by the laser.

In this embodiment, the substrate protection layers 310 and 320, each having a melting point higher than a melting point of the insulating substrate 200, may be formed on at least one surface of the insulating substrate 200 to prevent the insulating substrate 200 from being damaged by direct irradiation of laser ray to the insulating substrate 200 in the seed layer removing process.

Moreover, in this embodiment, even when the laser ray passes through the substrate protection layers 310 and 320 to be directly irradiated to the insulating substrate 200, warpage, caused by damage of the insulating substrate 200, or the like, may be prevented and a defect rate may thereby be decreased because the insulating substrate 200 includes a glass cloth disposed on a plurality of layers.

Another Embodiment

Figure 5:
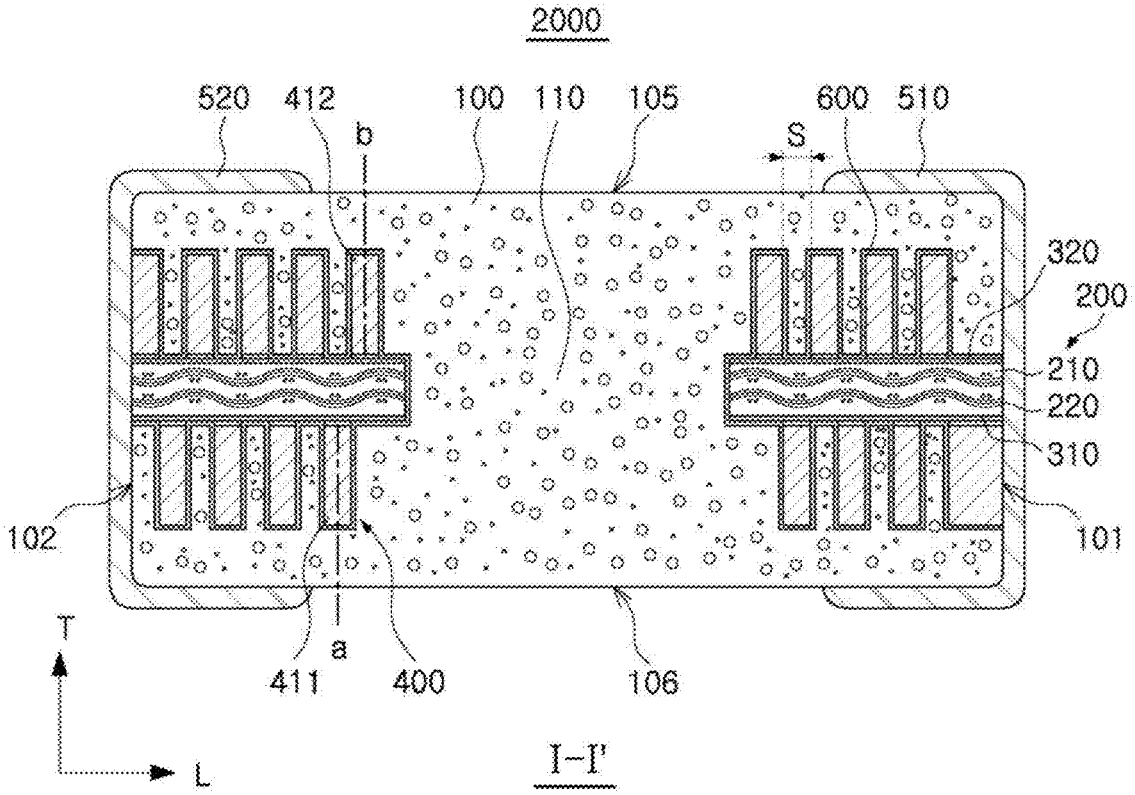
FIG. 5 is a schematic diagram of a coil component according to another example embodiment in the present disclosure, and corresponds to the cross-sectional view taken along line I-I' of FIG. 1.

FIG. 5 is a schematic diagram of a coil component according to another example embodiment in the present disclosure, and corresponds to the cross-sectional view taken along line I-I' of FIG. 1.

Referring to FIGS. 1 to 5, a coil component 2000 according to this embodiment has a coil portion 400 different from that of the coil component 1000 according to the one embodiment. Therefore, this embodiment will be described with respect to only the coil portion 400, which is a difference from the one embodiment. The descriptions of the one example embodiment may be applied, as it is, to the other elements of this embodiment.

Referring to FIG. 5, turns of first and second coil patterns 411 and 412 may overlap each other on the basis of a cross-section in a thickness direction of a body 100, but centerlines of the turns may be disposed to be offset from each other.

For example, the first and second coil patterns 411 and 412 may be formed such that the turns of the first and second coil patterns 411 and 412 overlap each other on the basis of a length-thickness direction end surface (an LT end surface) of the body 100, but center lines "a" and "b" of the turns may be disposed be offset from each other. When the turns of the first and second coil patterns 411 and 412 do not overlap with each other, there is a limitation in increasing the entire turns of the coil portion 400.

The first and second coil patterns 411 and 412 may be disposed such that an overlap ratio of each turn is 15% to 95%. As a non-limiting example, the overlap ratio may be calculated based on an overlapping area of turns of the first and second coil patterns 411 and 412, e.g. in a projection along the thickness direction. In one example, the overlap ratio is determined, on the basis of the LT end surface of the body 100. When a center line "a" of a single turn of the first coil pattern 411 matches (e.g., aligns with) a center line "b" of a single turn of the second coil pattern 412, the overlap ratio is defined as 100% (e.g., in a case in which the turns have the same widths). When a centerline "a" of a single turn of the first coil pattern 411 is disposed in the center of a space S between adjacent turns of the second coil pattern 412, the overlap ratio is defined as 50% (e.g., in a case in which the coil turns are spaced apart from each other by half of a width of the turns). When opposing external sides of the first coil pattern 411, opposite each other in a length (L) direction of a single turn, are disposed only in space S (e.g., the space between adjacent turns of the second coil pattern 412) and do not overlap with the second coil pattern 412 in the thickness direction, the overlap ratio is defined as 0%.

In the first and second coil patterns 411 and 412, when the overlap ratio of each turn is less than 15%, it may be difficult to increase the number of total turns of the coil portion 400 and the insulating substrate 200 may be warped. When the overlap ratio of each turn is greater than 95%, both surfaces of the insulating substrate 200 may be damaged by laser to increase the possibility of penetration of the insulating substrate 200.

In this embodiment, since the first coil pattern 411 and the second coil pattern 412 are disposed to be offset from each other in the above-mentioned manner, penetration of the insulating layer 200 may be significantly reduced even when both surfaces of the insulating substrate 200 are damaged by laser.

As described above, according to the present disclosure, an insulating substrate may be prevented from being damaged during a manufacturing process of a coil component. Thus, characteristics of the coil component may be improved.

While example embodiments have been shown and described above, it will be apparent to those skilled in the art that modifications and variations could be made without departing from the scope of the present disclosure as defined by the appended claims.

What is claimed is:

1. A coil component comprising:

a body;

an insulating substrate, embedded in the body, including an insulating resin;

first and second substrate protection layers covering respective surfaces of the insulating substrate to protect the insulating substrate and including a ceramic;

a coil portion including first and second coil patterns respectively disposed on the first and second substrate protection layers; and an insulating layer covering the first and second coil patterns, the first and second substrate protection layers, and a side surface of the insulating substrate, wherein each of the first and second coil patterns includes a first conductive layer, disposed on the respective first or second substrate protection layer, and a second conductive layer disposed on the first conductive layer to expose a side surface of the first conductive layer.

2. The coil component of claim 1, wherein the ceramic includes at least one of zirconia ($ZrO_2$), alumina ($Al_2O_3$), silica ($SiO_2$), and yttria ($Y_2O_3$).

3. The coil component of claim 1, wherein the insulating substrate further includes a glass cloth impregnated in the insulating resin.

4. The coil component of claim 3, wherein the glass cloth is formed of a plurality of layers.

5. The coil component of claim 1, wherein a ratio of a thickness of each of the first and second substrate protection layers to a thickness of the insulating substrate is 1/3000 or more to 1/4 or less.

6. The coil component of claim 1, wherein the first and second coil patterns are disposed on respective surfaces of the insulating substrate opposite each other in a thickness direction, turns of the first and second coil patterns are disposed to overlap each other in the thickness direction, and center lines of the turns are disposed to be offset from each other along the thickness direction.

7. A coil component comprising:

a body including metal magnetic powder particles;

an insulating substrate embedded in the body;

a coil portion including a coil pattern disposed on the insulating substrate;

a substrate protection layer, disposed on at least one surface of the insulating substrate between the insulating substrate and the coil portion to protect the insulating substrate, having a melting point higher than a melting point of the insulating substrate; and an insulating layer disposed on the coil pattern, the first and second substrate protection layers, and a side surface of the insulating substrate.

8. The coil component of claim 7, wherein the coil pattern includes the seed layer, disposed directly on the substrate protection layer, and an electroplating layer disposed on the seed layer to expose a side surface of the seed layer.

9. The coil component of claim 8, wherein the seed layer includes at least one of molybdenum, chromium (Cr), and titanium (Ti), and the electroplating layer includes copper (Cu).

10. The coil component of claim 9, wherein each of the seed layer and the electroplating layer includes copper (Cu), and density of copper in the electroplating layer is higher than density of copper in the seed layer.

11. A coil component comprising:

an insulating substrate;

a coil portion including first and second coil patterns disposed on opposing surfaces of the insulating substrate;

first and second ceramic layers each disposed between the insulating substrate and a respective one of the first and second coil patterns; and an insulating layer covering each of the first and second coil patterns, the first and second ceramic layers and a side surface of the insulating substrate.

12. The coil component of claim 11, wherein the first and second ceramic layers each have a melting point higher than a melting point of the insulating substrate.

13. The coil component of claim 11, wherein each of the first second coil patterns includes a plurality of coil turns spaced apart from each other on a surface of a respective one of the first and second ceramic layers, the surfaces of the insulating substrate having the first and second coil patterns disposed thereon are opposite each other in a thickness direction, and portions of the surface of the first ceramic layer between adjacent turns of the first coil pattern overlap in the thickness direction with portions of the surface of the second ceramic layer between adjacent turns of the second coil pattern.

14. The coil component of claim 11, wherein each of the first second coil patterns includes a plurality of coil turns spaced apart from each other on a surface of a respective one of the first and second ceramic layers, the surfaces of the insulating substrate having the first and second coil patterns disposed thereon are opposite each other in a thickness direction, and centers of portions of the surface of the first ceramic layer between adjacent turns of the first coil pattern are offset in a length direction orthogonal to the thickness direction relative to centers of portions of the surface of the second ceramic layer between adjacent turns of the second coil pattern.

15. The coil component of claim 11, wherein the insulating substrate includes a glass cloth impregnated in an insulating resin.

16. The coil component of claim 11, wherein the ceramic layers includes at least one of zirconia ($ZrO_2$), alumina ($Al_2O_3$), silica ($SiO_2$), and yttria ($Y_2O_3$).

17. The coil component of claim 11, wherein a ratio of a thickness of each of the first and second ceramic layers to a thickness of the insulating substrate is 1/3000 or more to 1/4 or less.

18. The coil component of claim 11, wherein each of the first and second coil patterns includes the seed layer having a first surface disposed on a respective one of the first and second ceramic layers, and an electroplating layer disposed on a second surface of the seed layer opposite the first surface.

19. The coil component of claim 18, wherein the electroplating layer of each of the first and second coil patterns is disposed on only the second surface of the seed layer, from among the first and second surfaces of the seed layer and side surfaces of the seed layer extending between the first and second surfaces.

* * * * *